US007521585B2

(12) United States Patent
Arcuri et al.

(10) Patent No.: US 7,521,585 B2
(45) **Date of Patent: *Apr. 21, 2009**

(54) RECOVERY OF NITRAMINES AND TNT FROM MIXTURES THEREOF

(75) Inventors: Kym B. Arcuri, Tulsa, OK (US); Duane A. Goetsch, Andover, MN (US); Steve J. Schmit, Ramsey, MN (US); Ryan M. Smith, Minnetonka, MN (US)

(73) Assignee: G.D.O. Inc, Elk River, MN (US)

( * ) Notice: Subject to any disclaimer, the term of this patent is extended or adjusted under 35 U.S.C. 154(b) by 754 days.

This patent is subject to a terminal disclaimer.

(21) Appl. No.: 10/766,401

(22) Filed: Jan. 26, 2004

(65) Prior Publication Data

US 2005/0087273 A1 Apr. 28, 2005

Related U.S. Application Data

(63) Continuation-in-part of application No. 10/444,442, filed on May 23, 2003, now Pat. No. 6,777,586.

(51) Int. Cl.

| | |
|---|---|
| ***D03D 23/00*** | (2006.01) |
| ***D03D 43/00*** | (2006.01) |
| ***A62D 3/20*** | (2007.01) |
| ***A62D 3/00*** | (2007.01) |

(52) U.S. Cl. ..... 588/403; 149/124; 588/312; 588/408

(58) Field of Classification Search ..... 588/312, 588/403, 408; 149/124

See application file for complete search history.

(56) References Cited

U.S. PATENT DOCUMENTS

| | | | | |
|---|---|---|---|---|
| 5,279,492 | A * | 1/1994 | Somoza et al. | 241/5 |
| 5,284,995 | A * | 2/1994 | Melvin | 588/313 |
| 5,445,690 | A * | 8/1995 | Wulfman | 149/109.6 |
| 5,953,679 | A | 9/1999 | Morris | |
| 5,977,354 | A * | 11/1999 | Spencer et al. | 540/475 |
| 6,080,907 | A * | 6/2000 | Miller | 588/319 |
| 6,110,308 | A | 8/2000 | Ewald et al. | |
| 6,156,194 | A * | 12/2000 | Lamoureux | 210/172.3 |
| 6,284,661 | B1 * | 9/2001 | Yokoyama et al. | 438/706 |
| 6,777,586 | B1 | 8/2004 | Arcuri et al. | |

* cited by examiner

*Primary Examiner*—J. A. Lorengo
*Assistant Examiner*—James E McDonough
(74) *Attorney, Agent, or Firm*—Henry E. Naylor

(57) ABSTRACT

TNT and nitramines, such as RDX, are recovered from mixtures containing same. The present invention more particularly relates to the removal of such mixtures from munitions and the separation of components contained in the munitions.

6 Claims, 3 Drawing Sheets

RECOVERY OF NITRAMINES AND TNT FROM MIXTURES THEREOF

CROSS-REFERENCE TO RELATED APPLICATIONS

This is a continuation-in-part of U.S. Ser. No. 10/444,442 filed May 23, 2003 now U.S. Pat. No. 6,777,586.

FIELD OF THE INVENTION

The present invention relates to the recovery of TNT and nitramines, such as RDX from mixtures containing same. The present invention more particularly relates to the removal of such mixtures from munitions and the separation of components contained in the munitions.

BACKGROUND OF THE INVENTION

The United States Government is committed to removing obsolete and aged munition and explosive inventories from the active arsenal. Historically, demilitarization programs focused on disposal or destruction. Recently, there have been efforts to develop recycling and/or reclamation processes that permit explosives and higher valued constituents of munition systems to be recovered and re-used in either military or civilian applications.

There are significant stockpiles of octols (mixture of TNT and HMX), cyclotols such as Composition B (mixture of TNT and RDX) as well as other explosive mixtures containing TNT that are no longer part of the active inventory and are awaiting demilitarization. These explosives currently exist as either bulk materials or they are contained in munitions.

The recovery of the individual explosive components contained in mixtures of nitramines and TNT can be highly desirable in demilitarization scenarios in which the mixture no longer has military or commercial value. To date, there has been little published art relating to the recovery of these constituents using solvent extraction. U.S. Pat. No. 5,977,345 to Spencer discloses a method in which the TNT component is melted and separated from the nitramine component by use of a sieve tray. The solid nitramine is then contacted with a solvent that preferentially dissolves the TNT leaving the nitramine in a relatively high purity state.

Both RDX (cyclotrimethylenetrinitramine) and HMX (cyclotetramethylene tetranitramine) have a significant solubility in molten TNT resulting in both a yield loss of these constituents as well as in contaminating the recovered TNT.

The Spencer method, with regard to demilitarizing munition-derived materials and recovering the RDX component, results in both yield and purity issues with respect to the recovered solid nitramine and TNT. The explosive mixture derived from munitions will usually contain additional materials associated with the liner (typically an asphalt-based compound) and the sealing material (typically, a resin or rosin based material). It has been shown that the presence of trace quantities of asphalt enhance the sensitivity of TNT as measured by conventional impact and thermal sensitivity tests. The contacting of molten TNT and asphalt while passing through a sieve device raises safety issues that must be addressed when considering a commercially sized (>100 lb/day) process system. Additionally a de-sensitizing agent is often used with the nitramine component. For example in Composition B mixtures, a natural wax is employed to coat the RDX particles in order to reduce the sensitivity of this material with respect to mechanical shocks. Other types of de-sensitizing agents include soaps and stearates. The deposition of the de-sensitizing agent is an important aspect of the recovery process possibly requiring an additional step for separation and removal from the recovered energetic materials.

The munition liner and sealing materials will typically collect on the sieve along with the nitramine. The asphalt material may transform to a highly viscous paste-like material that can readily block the sieve. The presence of these additional components within the solid nitramine matrix can adversely affect the purity and subsequent re-use as a high valued material. In addition, the asphalt liner material is highly soluble in toluene (a solvent for TNT) and can thus contaminate the recovered TNT. Spencer teaches the use of toluene as the solvent for removing residual TNT from RDX.

Therefore, there remains a need in the art for an improved method for recovering TNT and nitramines from mixtures containing same, particularly munitions containing same.

SUMMARY OF THE INVENTION

In accordance with the present invention there if provided a process for recovering the components of a munition containing explosive components and non-explosive components, wherein the explosive components are comprised of a nitramine component in a TNT matrix and wherein the non-explosive components are selected from a liner material comprised of asphalt and a sealer material comprised of a wax or polymeric material and which non-explosive components are of a lower density than said explosive components, which process comprises:

a) opening said munition using a high pressure water stream containing abrasive particles to expose said explosive and non-explosive components;

b) removing substantially all of said explosive components and at least a portion of said non-explosive components from the munition by use of a high pressure water stream, which water, explosive components, the abrasive and at least a portion of non-explosive components is referred to as the feed matrix;

c) cooling the feed matrix to a temperature lower than about 80° C. in the event the feed matrix is at a temperature greater than about 80° C.;

d) conducting the cooled feed matrix to a settling vessel wherein at least a portion of the non-explosive components rise to the surface of the water in said vessel and the abrasive and explosive components sink at a rate to the bottom;

e) drawing-off water containing non-explosive components and passing it to a solids/liquid separation zone wherein the non-explosive solids are separated from the water;

f) recycling at least a portion of the water to settling vessel of step c) above;

g) conducting an aqueous slurry of abrasive and explosive components from the bottom of said settling vessel to an abrasive separation zone wherein the abrasive material is separated from the nitramine and TNT components;

h) collecting the abrasive material;

i) passing the separated nitramine and TNT components to a water displacement zone wherein substantially all of the water is displaced with methanol thereby resulting in a slurry comprised of nitramine solids in TNT in methanol solution;

j) passing the resulting of slurry of nitramine solids in TNT in methanol to an extraction/separation zone wherein the nitramine solids are separated from the TNT in methanol solution;

k) passing the TNT in methanol solution to a flash zone wherein methanol is vaporized and wherein TNT crystallizes and settles to the bottom;

l) recovering the vaporized methanol;

m) passing the crystallized TNT to a stripping zone where it is contacted with steam to strip remaining methanol;

n) passing the stripped TNT to a drying zone wherein it is dried to a predetermined level.

In a preferred embodiment, the separation technique for separating the nitramine particles from the TNT/solvent solution is selected from the group consisting of gravity settling and filtration.

In other preferred embodiments, the abrasive material has magnetic properties and is preferably a garnet.

In yet other preferred embodiments, the abrasive separation zone is a magnetic separator and the separated nitramine solids are mixed with a mixture of isopropyl alcohol and water after removing the TNT using solvent washes.

In still another preferred embodiment the methanol, after TNT recovery is condensed and recycled.

DETAILED DESCRIPTION OF THE INVENTION

The following discussion uses Compositoin B as the explosive mixture that is comprised of TNT and RDX as the nitramine. It is to be understood that the instant process can be applied to any mixture of nitramine and TNT, including mixtures of HMX and TNT or RDX and TNT.

Figure 1:
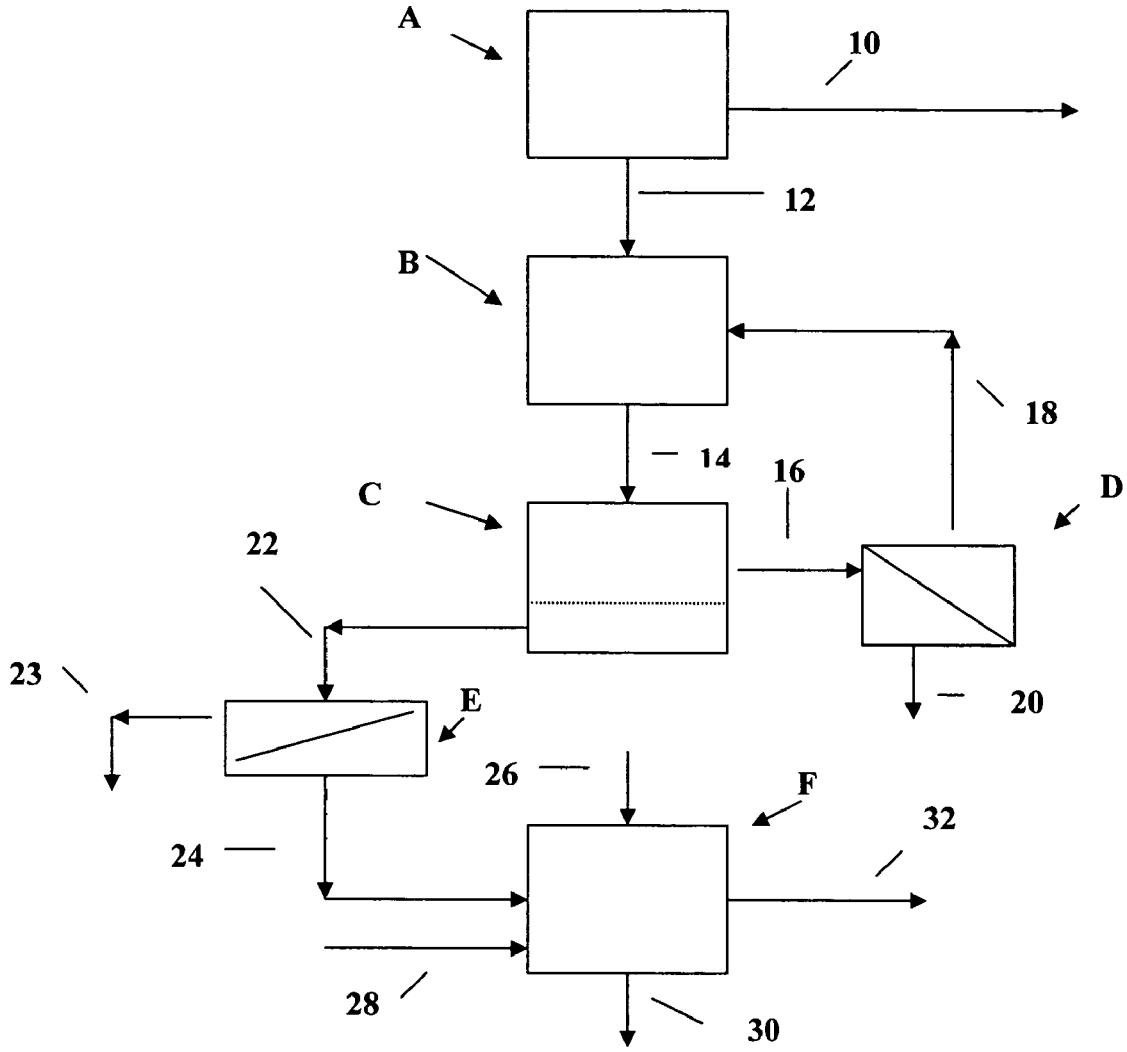
FIG. 1 is a flow diagram of the accessing stage of a preferred embodiment of the present invention when munitions are being processed using fluid jet technology.

The overall process of the present invention is schematically shown in the 3 figures hereof. FIG. 1 shows accessing of munitions containing Composition B. For those cases where the nitramine and TNT mixture is in bulk form and not contained in a munition casing, the process of the present invention will begin with FIG. 2 hereof. The term "munition" as used herein refers to a military shell that contains a mixture of at least one nitramine and TNT, which military shell includes both projectiles and bombs. The typical amount of TNT found in Composition B is at least about 35 wt. %, preferably at least about 40 wt. %, more preferably greater than 50 wt. %, and even as high as 4:1 TNT to RDX. A more preferred Composition B composition contains about 39.5 wt. % TNT and 59.5 wt. % RDX. The munition is typically coated on its interior surface with an organic liner material. Non-limiting examples of organic liner materials used for military shells include asphaltic liners, paints, and any other suitable liner material that provides a chemically stable coating that is capable of preventing the Composition B from coming into contact with the metal casing. In most cases, a sealer material is used to fill a gap left after the shell is filled with the explosive material. The presence of liner and sealer materials makes it difficult to obtain relatively pure yields of TNT and RDX from munitions. The sealer material will usually be comprised of such things as waxes, synthetic or natural resins, or other suitable polymeric material and will typically be found at the filling end of the shell. For example, a shell, or munition casing, is filled with molten explosive material that upon solidification will undergo a relatively small amount of shrinkage that will leave an unacceptable void or space. This space will be filled with a suitable sealer material that will undergo little, if any, shrinkage upon solidification. After the space is filled with sealer material, the munition is closed by attaching a suitable end piece.

In the practice of the present invention, TNT and nitramine powder (RDX in the case of Composition B) are recovered from each other, as valuable discrete commercial products. The de-sensitizing agent, liner, and sealing material may also be recovered in such a manner to be re-sold as commercial materials. As previously mentioned, conventional methods for disposing of Composition B-containing military shells, including such things as melting, incineration, chemical degradation, and detonation, are not capable of recovering the TNT and RDX powder as discrete components.

Turning now to FIG. 1 hereof, munitions are accessed in accessing zone A. The shell, or munition casing is first cut to expose its contents for removal. Any suitable technique can be used to open the shell and expose its contents. One preferred technique is the use of fluid-jet cutting technology. Fluid-jet cutting technology is disclosed in U.S. Pat. Nos. 5,363,603 and 5,737,709 both of which are incorporated herein by reference. Although the shell can be cut across its longitudinal axis at a point that will expose substantially all of the components for removal, it is preferred to expose the explosive component by defuzing the shell. That is, by cutting around the fuze with a high-pressure fluid stream until it is free from the casing. This, or course is preferred for safety considerations. The operating pressure of the fluid jets will preferably be from about 20,000 to about 150,000 psi, preferably from about 40,000 to about 150,000 psi. The diameter of the washout jet stream will typically be in the range of about 0.001" to about 0.02".

The high pressure fluid stream, which will typically be water for the purposes of this these figures will preferably contain abrasive solids for improved cutting efficiency of the fluid jet stream, thereby reducing the time and energy requirements. Any suitable abrasive material can be used, but it is preferred that an abrasive having paramagnetic properties be used. It is more preferred to use a paramagnetic abrasive material to allow easier separation and recovery of the abrasive material using a magnetic filter. Garnet is the most preferred paramagnetic abrasive materials. Non-limiting examples of other abrasive materials that can be used in the practice of the present invention include copper particles, apaetite, corundum and hematite. After the munition is cut open the energetic and other components are exposed and can be washed also using the fluid jet. The washout of the explosive mixture can utilize a pure water stream free of any abrasive material. It is within the scope of this invention that a single fluid jet stream be used for both cutting (accessing) and for wash out of the explosive material once the casing is cut open. It is also within the scope of this invention that two different fluid jet streams be used. A first fluid jet stream containing an abrasive material can be used to cut open the munition casing and a second fluid jet stream, without abrasive material, can be used to washout the contents of the casing. It is preferred that two separate fluid jet streams be used. This minimizes the amount of abrasive, sealing and asphalt material that may embed within the TNT particles as they solidify in the cooling step.

The empty munition casings are collected from accessing zone A via line 10 upon completion of the cutting and washout operations. The resulting slurry, which is comprised of washout fluid, the explosive mixture, and other constituents from the munition casing, such as the liner and sealer materials, are conducted via line 12 to cooling zone B since the temperature of the washout fluid can be as high as about 90° C. If two separate fluid jets are used for the cutting and washout steps, the effluent stream from each step can be combined and conducted to cooling zone B.

Because the temperature of the fluid from accessing zone A can be as high as 90° C., the TNT may be in a molten state as it leaves accessing zone A and is passed to cooling zone B. Lower temperatures may be encountered in systems that have significant heat losses to the ambient environment. In order to ensure solidification of any molten TNT, it is necessary to cool the slurry in cooling zone B to temperatures below about 80° C.

Upon cooling and re-solidification of any molten TNT, the slurry is then passed via line 14 to separation zone C to separate the explosive components from the non-explosive components, such as the liner and sealer materials. The density of the liner and sealing materials commonly used in munition cavities is typically significantly less than that of the explosive components. The separation of the lower density constituents from the explosive mixture can be accomplished by any suitable means, such as by use of gravity based settlers that are well known and readily commercially available. These include cone shaped settlers or other geometries that can preferably include internal baffle plates to assist in the separation. The separation is based on the difference in the densities and settling velocities between the explosive constituents and non-explosive constituents. A separate water feed stream to the separation zone C (not shown) may be included if additional up flow is necessary. The lower density liner and sealer material will be swept away from the settled TNT and RDX particles in the overflow stream via line 16 to filter D to remove solids. The abrasive particles contained within the slurry will preferably possess particle densities comparable or greater than the explosive constituents. Only very small abrasive particles will be removed with the liner and sealer material since the settling velocity of the very small particles will be comparable to that of the non-explosive constituents. If desired these small magnetic abrasive particles can be further separated by magnetic filtration.

A portion of this overflow stream, which contains a significant amount of water, can be recycled via line 18 and re-used in the cooling zone B. The amount of water recycled depends upon such things as the selection of the cooling system employed in cooling zone B. Up to 100% of the effluent water can be recycled in this manner. Any portion not recycled can be treated as required for eventual discharge. The abrasive, liner and sealer material are periodically removed from the filter for disposal via line 20.

The settled solids of separation zone C include the explosive constituents and most likely some abrasive material (if used). If the abrasive material has magnetic properties the stream is conducted via line 22 to magnetic filter E where magnetic abrasive material is removed. The abrasive material is removed from the slurry and collected via line 23, thus allowing passage of the nitramine, TNT and water which is conducted via line 24 to water displacement zone F. Any suitable type of magnetic based separation (filtering) device can be used for magnetic filter E including both fixed and electromagnetic based systems.

A continuous water phase of the slurry, which now is primarily comprised of nitramine, TNT and water and which was conducted to displacement zone F is separated from the explosive constituents and collected via line 30. This dewatering of the slurry can be accomplished using any suitable technique that is commonly used in solid-liquid separations in which a dried solid is desired. For example, a Neusche filter, filter press or rotary filter can be used. The water displacement step involves removing the free flowing water. In some cases it may be desirable to remove the water associated with the static holdup by use of a drying gas via line 26. The use of a cone shaped settler can also be employed since the nitramine and TNT are to be contacted with methanol. Consequently, a gravity settler can be employed in displacement zone F in which water is displaced from the explosive constituents through dilution with methanol that is introduced via line 28. This offers simplicity in the mechanical design at a cost of generating relatively large volumes of methanol-water mixtures, requiring separation for subsequent re-use of these materials. It is preferred to reduce the water content within the nitramine/TNT slurry to less than 20 wt. %. Reductions to less than 8 wt. % is more preferred since this reduces the amount of subsequent water separation processing in latter process steps. Reductions to less than 3 wt. % is most preferred. Additionally, the presence of high amounts of water (>10 wt. %) can lead to higher methanol consumption rates in latter process steps. The effluent water and water-methanol mixtures are collected via line 30 and the liquid constituents are separated into relatively pure form (>97% purity) for subsequent re-use in the process.

It is to be understood that accessing zone A of the process as shown in FIG. 1 can assume many different embodiments depending upon site specific issues, throughput, desired purity levels and selection of desired operating mode. For example, if one wished to operate the system in a batch type operation, the volumes representing the separation, magnetic filtering and water displacement can be combined into a single vessel. In the extreme case of batch operations, the cooling and mixing step can also be included in a single vessel. The explosive components in methanol are collected via line 32 for further processing.

Figure 2:
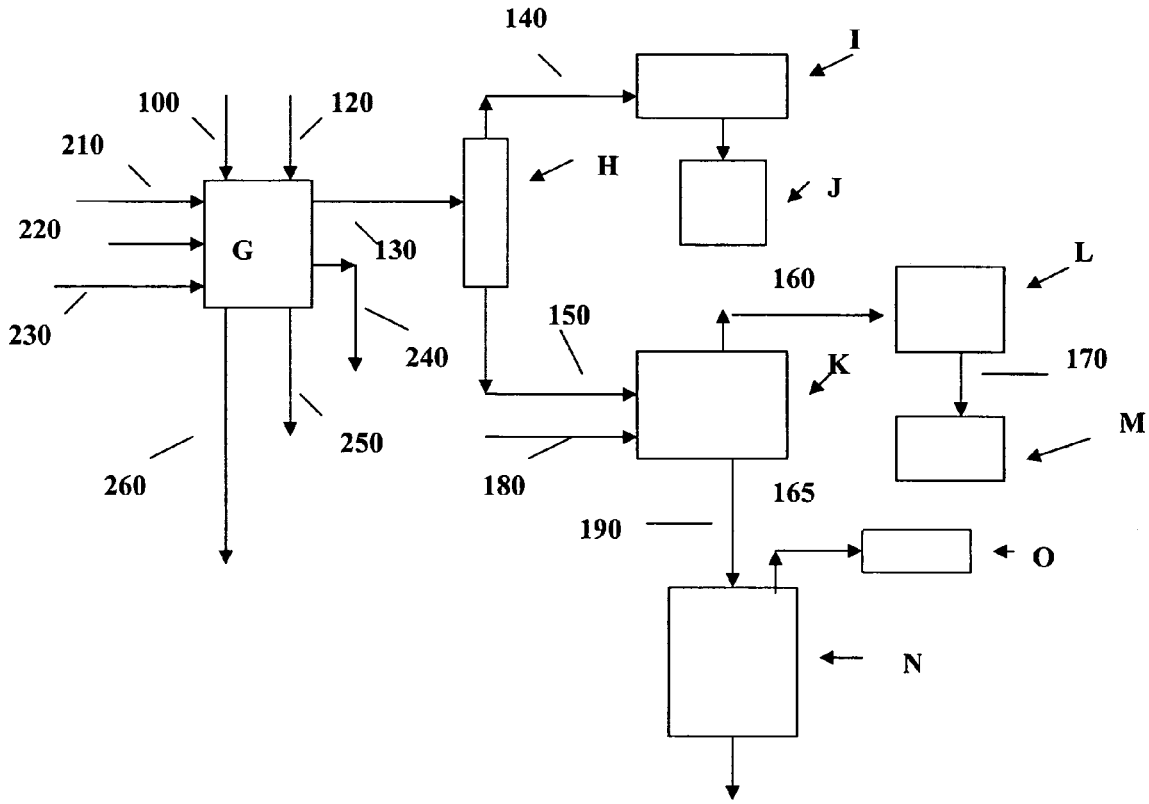
FIG. 2 hereof is a flow diagram of a preferred method for recovering and recycling solvents used in the process of the present invention.

Reference is now made to FIG. 2 hereof wherein a mixture of nitramine and TNT is introduced via line to extraction/separation zone G. It will be understood that if the nitramine/TNT mixture was contained in a munition, then it would have been accessed and removed via FIG. 1 hereof and conducted via line 32 of FIG. 1 and line 100 via FIG. 2 to extraction/separation zone G. The extraction/separation zone G will preferably be comprised of a vessel in which TNT and RDX are contacted with water and various solvents. If the mixture originated from a munition then it would enter extraction/separation zone G in methanol and there would be no need for methanol being introduced via line 120. If the mixture is from a bulk source then methanol would be introduced into extraction/separation zone G via line 120. Methanol has a greater solubility with respect to TNT than for the nitramines, such as RDX. Thus, the TNT preferentially dissolves in the methanol. The mass ratio of methanol to TNT should be sufficient to allow for the substantially complete dissolution of the TNT into the methanol. This of course depends upon the solubility of TNT in methanol, which in turn depends upon the temperature. For example, at room temperature, the solubility of TNT in methanol is approximately 3.5 gms per 100 grams of methanol. At about 40° C. the solubility increases to approximately 9.9 gm/100 gm. Higher temperatures reduce the amount of methanol necessary to completely dissolve the TNT. The preferred operating temperature is in the range of about 40-70° C. in order to minimize the amount of methanol. The vessel of extraction/separation zone G will preferably be operated under pressures greater than ambient in order to maintain the methanol in a liquid state.

The contacting of the TNT/RDX mixture with methanol is preferably repeated a number of time, preferably two more times for a total of three methanol contact steps, in order to ensure that the residual TNT remaining with the settled solid matrix is sufficiently low to meet the purity specifications of the recovered RDX. For high purity RDX, the residual TNT levels will preferably be less than about 0.5 wt. %, and more preferably less than about 0.3 wt. %. Extraction/separation zone G can be operated in various phases. For example, in a first phase, the methanol and TNT/RDX mixture are mixed using a number of conventional devices, such as but not limited to, the use of mixing paddles and slurry pump around loops. The contact time between the methanol and the TNT/RDX mixture in this first phase should be sufficient to dissolve essentially all of the TNT (typically 0.5 to 4 hours depending upon the size of the explosive particles, the extent of mixing, and the temperature). After the initial contacting and dissolution of TNT into the first batch of methanol, the mixing device is turned off and the RDX particles are allowed to settle. The TNT/methanol solution is than drawn-off from the settled solids and transferred via line 130 to flash vessel H. A filter (not shown) can be employed in line 130 in order to prevent the loss of any RDX particles in the TNT/methanol stream. The orientation of line 130 with respect to extraction/separation zone G may be established to allow upward flow of the liquid as it is withdrawn. The vessel constituting extraction/separation zone G can employ several of the solid/liquid settler designs commercially available. For example, a conventional cone shaped settling or internally baffled Lamella type settler vessel can be employed. Alternately a Neusche filter design can be employed in which the liquid is withdrawn through a filter through the bottom of the volume.

Recovery of TNT

The TNT/methanol solution will exit extraction/separation zone G in FIG. 2 hereof via line 130 and sent to flash zone H where the methanol is vaporized and whereupon the TNT crystallizes and settles. Flash zone H can be operated at temperatures below or above the melting point of the TNT. The preferred operating conditions for flash zone H are 90-85° C. and 14.7 to 25 psia. When operating at temperatures below the melting point of the TNT, crystallization will occur as the solution exceeds the solubility limit. Mixing can be employed in flash zone H to promote the formation of relatively large TNT particles (>50 microns) that readily settle to the bottom of the flash vessel for subsequent collection. When operating above the melting point of the TNT, the degree of mixing is not critical, however the load to the condenser I will be higher. Steam, or other suitable heating source, can be employed to provide the heat of vaporization. The methanol vapor passes to condenser I via line 140 and is stored in vessel I for re-use at a later time.

The TNT either in a settled solid or molten state, will settle towards the bottom of the vessel used for flash zone H and be withdrawn via line 150 and sent to stripping zone K where it is contacted with steam via line 180 in order to strip residual methanol. The preferred method involves vaporizing or flashing the methanol by incrementing the temperature such that at the end of the flashing step the temperature is sufficiently high enough to allow the TNT to melt into the liquid state. In cases where the TNT is collected as settled particles, the extent of steam stripping must be sufficient to remove substantially all of the methanol contained within the void volume of the solids. In the case of molten TNT, the extent of steam stripping is reduced since there will be considerably less methanol within the molten matrix. During stripping, the methanol and steam vapor passes via line 160 to condenser L and sent to storage vessel M via line 170. The mixture is than later separated by distillation for re-use. The molten TNT then passes to a drying zone N via line 190 where water is removed to a desired level. The drying zone is preferably comprised of a conventional drying kettle system. The water (possibly containing trace quantities of methanol) passes via line 165 to condenser O and collected and stored (not shown) for re-use or disposal. Separation of the methanol and water constituents may be necessary in some cases.

The molten and dry TNT exiting the drying kettle system 80 is than processed to obtain the final desired product. For example a belt flaker can be employed to collect dry TNT for storage and shipment.

Removal of Wax from RDX

Referring back to the extraction/separation zone G, the settled RDX may contain a desensitizing agent, such as a wax, that is relatively insoluble in methanol. In another embodiment, when wax is the desensitizing agent, hexane can be introduced into zone G via line 210 at an effective volume necessary to allow complete dissolution of the wax. The dissolved wax/hexane solution is separated from the RDX. In the case where the vessel of zone G is configured as a Nutsche filter, the solution can be drained through the bottom via line 240. Multiple contacting steps with hexane may be necessary if the recovered RDX is to have significantly low wax levels (<0.1 weight %). In some cases it may not be necessary to remove any or significant quantities of the wax. Therefore in these cases, the hexane contacting phase can be omitted. It will be understood that in general, the solvent used to selectively remove the desensitizing agent will preferably have a boiling point less than about 100° C. at 1 atmosphere to allow easier recovery and re-use. Hydrocarbon solvents, other than hexane, can be used and the recovery step may be at sub-atmospheric conditions in order to maintain sufficiently low temperatures (preferably less than about 85° C.) to prevent degradation of residual explosives.

Removal of Residual Hexane (or Methanol) from RDX

The recovered RDX can be contacted with a mixture of isopropyl alcohol via line 220 and water for storage and shipment. In yet another embodiment the settled RDX (possible containing residual hexane) in initially contacted with isopropyl alcohol and removed from the system via line 250. The volume of isopropyl and the number of contacting steps is established by the requirement that the residual hexane level should be low, typically on the order of 0.1 wt % or less on a dry RDX basis. The amount of isopropyl alcohol and the number of contacting steps depends upon the geometry and type of design employed for the extraction/separation vessel. In the case where the hexane wash step is was not employed the isopropyl contacting steps can be employed to reduce the residual methanol to the desired value. It will be understood, that in general for nitramines, the nitramine is washed with an appropriate liquid that is preferably employed in the storage and transportation of the final nitramine product. This liquid wash step is used in order to remove the residual solvent and any associated dissolved wax. Repeated wash steps may be necessary to achieve the desired level of reduction for both the solvent and de-sensitizing agent. As previously mentioned, when the nitramine is RDX the preferred wash liquid is isopropyl alcohol.

Recovery of Final RDX Product

In still another embodiment, water is added to the isopropyl/RDX slurry for storage and transport. The slurry is then removed from the extraction/settling tank via line 260 for transport and storage. A solid/liquid separation step may be necessary since the volume fraction of liquid in the final RDX product may be excessive relative to that needed for transport and storage. A magnetic filter (not shown) may be employed for removing any residual particles associated with the swarf or abrasives in cases where the explosive mixture was derived from a munition cavity.

Reuse of Solvents and Water

Figure 3:
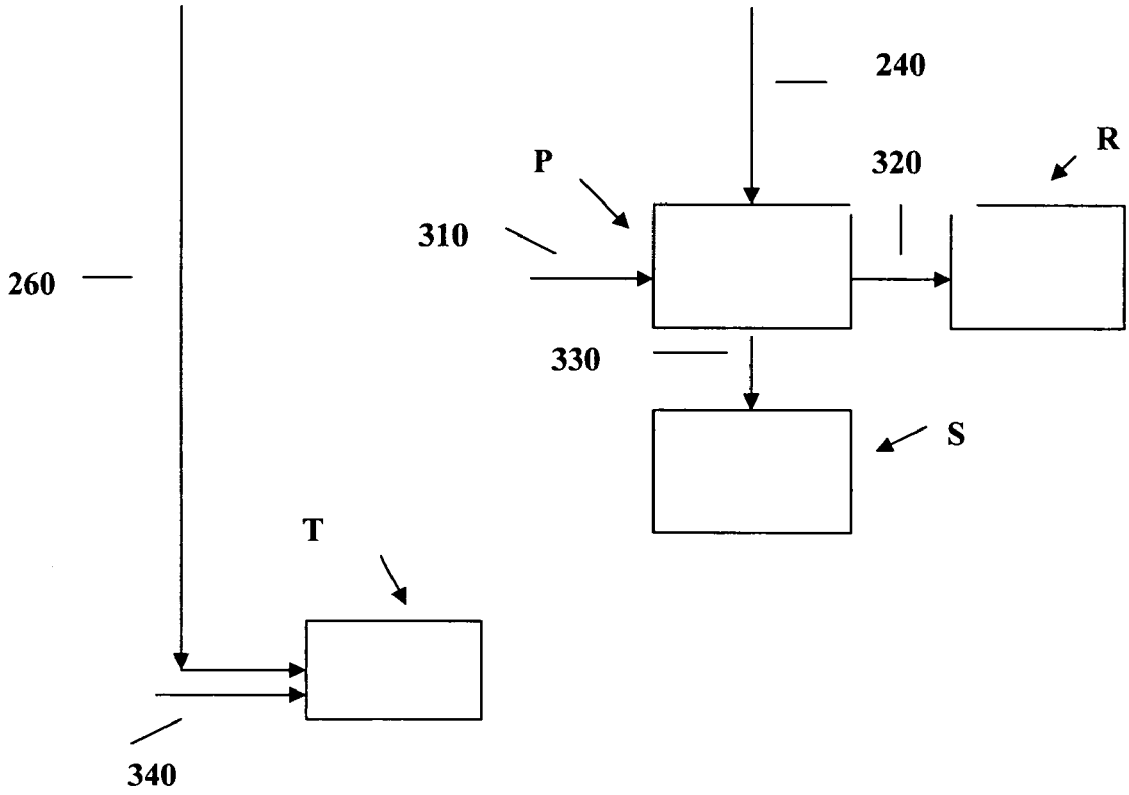
FIG. 3 hereof is a flow diagram of a preferred embodiment showing recovery of high purity nitramine and TNT from components of a munition.

The hexane/methanol, hexane/isopropyl, and isopropyl alcohol/methanol, isopropyl alcohol/water mixtures created in this process can be separated for re-use of the solvents. FIG. 3 hereof presents one of several preferred process configurations which can be employed for recovering the solvents used in the processing section. The hexane/wax solution displaced from the settled RDX particles by methanol as illustrated by line 240 of FIG. 2 hereof is conducted to volume P where it is contacted with water that is introduced via line 310. Volume P represents an extraction or contacting step where the methanol transfers from the hexane phase into the water phase. The resulting water/methanol mixture is conducted via line 320 into a storage vessel R for subsequent separation and reuse. The hexane/wax (or other desensitizing agent) solution is transferred to vessel S vial line 330 for sale as a commercial material. Further separation of this mixture can be accomplished through evaporation of the hexane. When wax is the desensitizing agent recovery of this material as a pure component is desirable due to its high value. In the case of the hexane/isopropyl mixture, a water extraction step T is necessary to recover the hexane due to the formation of an azeotroph. The hexane/isopropyl mixture is transferred via line 260 hereof to extraction zone T of FIG. 3 hereof. Water is introduced via line 340 for separation of the hexane from the isopropyl alcohol using extraction. The alcohol is transferred to the aqueous phase and can be recycled and reused after a distillation step. The hexane can be dried and re-used in the process.

It will be understood that the process schemes represented by the figures hereof show only one preferred embodiment for practicing the present invention. Other process schemes can be used and may be needed depending on such things as the desired end purity of the explosive components, the rate at which the process is conducted, whether or not the process is conducted in batch or continuous mode, whether or not the TNT/nitramine mixture is in bulk form or contained in a munition, and the amount and composition of any liner and sealer material. It is also understood that the process configurations of the present invention can be conducted in two separate process trains, each to the effluent stream associated with the cutting and washout steps through the entire recovery process. For example, the cutting operation can be operated in batch mode and the washout can be conducted in continuous mode, or each can be operated in various degrees between batch and continuous.

The invention claimed is:

1. A process for recovering the components of a munition containing explosive components and non-explosive components, wherein the explosive components are comprised of a nitramine component in a TNT matrix and wherein the non-explosive components are selected from a liner material comprised of asphalt and a sealer material comprised of a wax or polymeric material and which non-explosive components are of a lower density than said explosive components, which process comprises:

a) opening said munition using a high pressure water stream containing abrasive particles to expose said explosive and non-explosive components;

b) removing substantially all of said explosive components and at least a portion of said non-explosive components from the munition by use of a high pressure water stream, which water, explosive components, the abrasive and at least a portion of non-explosive components is referred to as the feed matrix;

c) cooling the feed matrix to a temperature lower than about 80° C. in the event the feed matrix is at a temperature greater than about 80° C.;

d) conducting the cooled feed matrix to a settling vessel wherein at least a portion of the non-explosive components rise to the surface of the water in said vessel and the abrasive and explosive components sink at a rate to the bottom;

e) drawing-off water containing non-explosive components and passing it to a solids/liquid separation zone wherein the non-explosive solids are separated from the water;

f) recycling at least a portion of the water to settling vessel of step c) above;

g) conducting an aqueous slurry of abrasive and explosive components from the bottom of said settling vessel to an abrasive separation zone wherein the abrasive material is separated from the nitramine and TNT components by settling based on the difference in the densities and settling velocities of the explosive and non-explosive components;

h) collecting the abrasive material;

i) passing the separated nitramine and TNT components to a water displacement zone wherein substantially all of the water is displaced with methanol thereby resulting in a slurry comprised of nitramine solids in TNT in methanol solution;

j) passing the resulting of slurry of nitramine solids in TNT in methanol to an extraction/separation zone wherein the nitramine solids are separated from the TNT in methanol solution;

k) passing the TNT in methanol solution to a flash zone wherein methanol is vaporized and wherein TNT crystallizes and settles to the bottom;

l) recovering the vaporized methanol;

m) passing the crystallized TNT to a stripping zone where it is contacted with steam to strip remaining methanol;

n) passing the stripped TNT to a drying zone wherein it is dried to a predetermined level.

2. The process of claim 1 wherein the separated nitramine solids are washed with hexane after removing the TNT using solvent washes.

3. The process of claim 1 wherein water is continuously introduced at the bottom half of said settling vessel of step d) at a rate lower than the settling rate of the explosive components.

4. The process of claim 1 wherein sealer material is removed from the feed matrix prior to the feed matrix being conducted to said first settling vessel.

5. The process of claim 1 wherein said nitramine are collected from step i), which nitramine solids contain a coating of desensitizing agent, which nitramine solids are contacted with a paraffinic solvent at conditions to dissolve said desensitizing agent there from.

6. The process of claim 5 wherein the desensitizing agent is a natural or synthetic wax and wherein the paraffinic solvent is hexane.

* * * * *